US011819058B2

(12) United States Patent
Wang et al.

(10) Patent No.: US 11,819,058 B2
(45) Date of Patent: Nov. 21, 2023

(54) ELECTRONIC CIGARETTE VAPORIZER AND ELECTRONIC CIGARETTE

(71) Applicant: Shenzhen Geekvape Technology Co., Ltd., Guangdong (CN)

(72) Inventors: Xianghui Wang, Guangdong (CN); Wenlong Lu, Guangdong (CN); Guilin Liu, Guangdong (CN); Shaojian Zheng, Guangdong (CN); Renming Tan, Guangdong (CN); Haohan Gu, Guangdong (CN); Zhengwei Xia, Guangdong (CN)

(73) Assignee: Shenzhen Geekvape Technology Co., Ltd., Shenzhen (CN)

( * ) Notice: Subject to any disclaimer, the term of this patent is extended or adjusted under 35 U.S.C. 154(b) by 504 days.

(21) Appl. No.: 17/024,721

(22) Filed: Sep. 18, 2020

(65) Prior Publication Data

US 2021/0112861 A1 Apr. 22, 2021

(30) Foreign Application Priority Data

Oct. 18, 2019 (CN) ..... 201921764606.7
Jun. 11, 2020 (CN) ..... 202021071628.8

(51) Int. Cl.
*A24F 40/40* (2020.01)
*A24F 40/10* (2020.01)

(52) U.S. Cl.
CPC ..... *A24F 40/40* (2020.01); *A24F 40/10* (2020.01)

(58) Field of Classification Search
CPC ..... A24F 40/10; A24F 40/40; A24F 40/42; A24F 40/485
See application file for complete search history.

(56) References Cited

U.S. PATENT DOCUMENTS

2017/0113007 A1* 4/2017 Wu ..... A61M 15/00
2018/0153220 A1* 6/2018 Verleur ..... A24F 47/00
2019/0230983 A1* 8/2019 Liu ..... A24F 47/00

* cited by examiner

*Primary Examiner* — Michael J Felton
*Assistant Examiner* — Daniel Edward Vakili

(57) ABSTRACT

Disclosed are an electronic cigarette and a vaporizer thereof which are suitable for adjusting air inflow with a single hand. The electronic cigarette vaporizer includes a vaporizer base and a liquid reservoir connected to the vaporizer. An atomizing cavity is formed by an internal cavity obtained by the connection of the liquid reservoir and the vaporizer base. An air inlet passage communicated with the atomizing cavity is arranged at the liquid reservoir. An adjusting knob at the entrance of the air inlet passage for adjusting air inflow is also arranged at the liquid reservoir. An air inlet is arranged at the adjusting knob. By rotating the adjusting knob, the air inflow can be adjusted by relative position changes of the air inlet and the entrance of the air inlet passage.

12 Claims, 6 Drawing Sheets

ELECTRONIC CIGARETTE VAPORIZER AND ELECTRONIC CIGARETTE

CROSS REFERENCE TO RELATED APPLICATIONS

The present application claims the benefit of Chinese Patent Application Nos. 201921764606.7 filed on Oct. 18, 2019 and 202021071628.8 filed on Jun. 11, 2020. All the above are hereby incorporated by reference.

FIELD OF INVENTION

The present disclosure relates to electronic cigarettes, in particular to electronic cigarettes and vaporizers thereof that can adjust air intake with one hand.

BACKGROUND

Most existing electronic cigarettes can only be provided with air inlets having fixed air intake (that is the air intake cannot be adjusted) due to size restrictions. Even if there have been electronic cigarettes with adjustable air intake (which are adjusted in a rotary manner, a toggling manner, or a manner with insertion of tobacco tank in a front or back way) on the market, people need to use both their left and right hands for adjustment, that is one hand to hold the cigarette body or tobacco tank and the other hand to adjust the air intake volume, resulting in inconvenient adjustment.

SUMMARY OF THE INVENTION

To overcome at least one drawback of the prior art, the present disclosure provides an electronic cigarette and vaporizer thereof that can adjust air intake with a single hand.

According to one aspect of the present disclosure, an electronic cigarette vaporizer provided includes a vaporizer base and a liquid reservoir connected to the vaporizer; wherein an atomizing cavity is formed by an internal cavity obtained by the connection of the liquid reservoir and the vaporizer base; an air inlet passage communicated with the atomizing cavity is arranged at the liquid reservoir; an adjusting knob at the entrance of the air inlet passage for adjusting air inflow is also arranged at the liquid reservoir; an air inlet is arranged at the adjusting knob; and by rotating the adjusting knob, the air inflow can be adjusted by relative position changes of the air inlet and the entrance of the air inlet passage.

According to another aspect of the present disclosure, an electronic cigarette provided includes the above-mentioned electronic cigarette vaporizer and a power supply component; wherein the electronic cigarette vaporizer is connected to the upper of the power supply component. Preferably, the connection method therebetween is detachable.

The beneficial effect of the present disclosure compared with the prior art is that with the electronic cigarette provided by the present disclosure, by arranging the adjustment knob for adjusting the air inflow on the liquid reservoir, the adjusting knob is just held at the thumb of a user's hand, and the adjusting knob can be rotated through the thumb, thereby adjusting air inflow quickly and conveniently, and improving user experience.

The above-mentioned description is only an overview of the technical solution of the present disclosure. In order to understand the technical means of the disclosure more clearly so as to implement it in accordance with the content of the specification, and to make the above-mentioned and other purposes, features and advantages of the disclosure more obvious and understandable, specific preferred embodiments are described in detail as follows.

LIST OF REFERENCE NUMERALS

Figure 1:
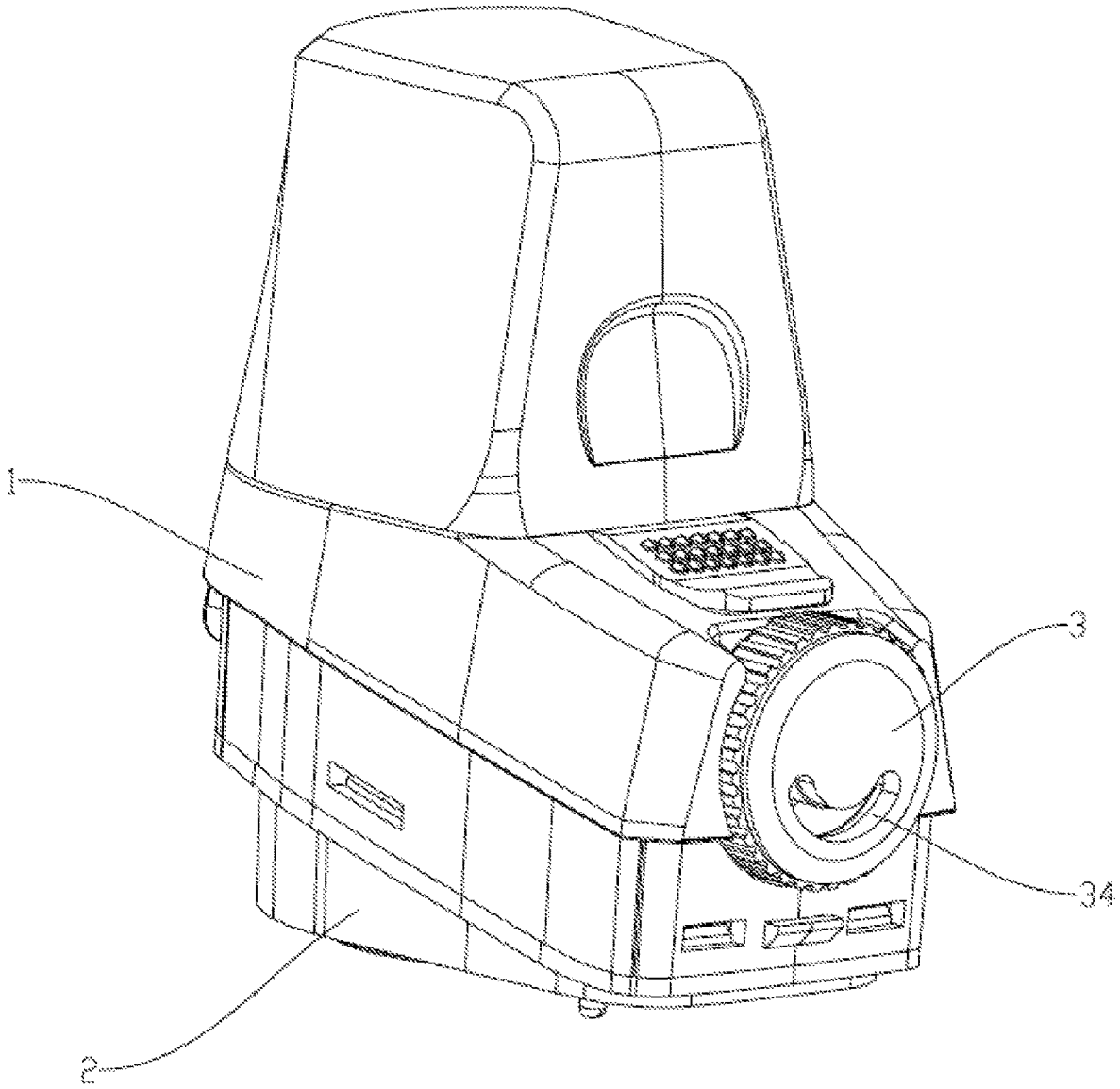
FIG. 1 is a schematically assembled diagram of an electronic cigarette vaporizer according to one embodiment of the present disclosure.

1 liquid reservoir;
11 mounting groove;
111 notch portion;
112 connecting hole;
12 annular plate;
121 notch;
122 third air inlet;
123 fourth air inlet;
13 vertical channel;
14 transverse channel;
2 vaporizer base;
3 adjusting knob;
31 air adjusting ring;
311 antislip rib;
312 bottom plate;
313 peripheral wall;
314 mounting hole;
315 first air inlet;
316 second air inlet;
32 fixed mount;
321 limit portion;
322 clamping portion;
33 sealing gasket;
34 air inlet;
4 power supply component;
400 atomization generator;
410 airflow passage;
500 power supply base;
510 positive electrode;
520 insulator;
530 negative electrode;
600 cigarette holder.

DETAILED DESCRIPTION

The technical solution of the present disclosure will be further introduced and illustrated below in conjunction with specific embodiments to fully understand the technical content of the present disclosure, but it is not limited thereto.

The technical solutions in the embodiments of the present disclosure will be clearly and completely described below in conjunction with the drawings in the embodiments of the present disclosure. Obviously, the described ones are only some embodiments of the present disclosure, rather than all of the embodiments. Based on the embodiments in this disclosure, all other embodiments obtained by those skilled in the art without creative work are within the protection scope of this disclosure.

It is understood that the terms "center", "longitudinal", "transverse", "length", "width", "thickness", "upper", "lower", "front", "back", "left", "right", "vertical", "horizontal", "top", "bottom", "inner", "outer", "clockwise", "counterclockwise", etc. indicating directional or positional relationship in the description of the present disclosure are based on the orientation or position relationship shown in the drawings, and are only for the convenience of describing the disclosure and simplifying the description. They do not indicate or imply that the apparatus or element referred to must have a specific orientation, be constructed and operated in a specific orientation, therefore they cannot be understood as restrictions on the present disclosure.

In addition, the terms "first", "second", etc. are only used for descriptive purposes, and cannot be understood as indicating or implying relative importance or implicitly indicating the number of indicated technical features. Thus, the features defined with "first", "second" and etc. may explicitly or implicitly include one or more of these features. In the description of the present disclosure, "multiple" means two or more than two, unless otherwise specifically defined.

The terms "installed", "connect" "couple", "fixed", etc. in the present disclosure should be interpreted broadly, unless otherwise clearly specified and limited. For example, they may be connected, or detachable, or integrated; or they may be a mechanical connection or an electrical connection; or they may be directly connected, or indirectly connected through an intermediate medium, or they may be internal communication or the interaction relationship between two components. For those skilled in the art, the specific meanings of the above terms in the present disclosure can be understood according to specific circumstances.

A first feature "on" or "under" a second feature in the present disclosure may include direct contact of the first and second features, or may include the first feature contacting the second feature through other features, unless otherwise clearly specified and limited. Moreover, the first feature "above", "over" and "on top of" the second feature may include the first feature being directly above or obliquely above the second feature, or may simply mean that the level of the first feature is higher than that of the second feature. The first feature "below", "under" or "beneath" the second feature may include the first feature being directly below or obliquely below the second feature, or may simply mean that the level of the first feature is lower than that of the second feature.

Description with reference to the terms "one embodiment", "some embodiments", "example(s)", "specific example(s)" or "some examples" etc. in the specification may mean that specific feature(s), structure(s), material(s) or characteristic(s) described in conjunction with the embodiment(s) or example(s) is/are included in at least one embodiment or example of the present disclosure. The schematic representations of the above-mentioned terms in the specification should not be understood as necessarily referring to the same embodiment(s) or example(s). Moreover, the described specific feature(s), structure(s), material(s) or characteristic(s) may be combined in any one or more embodiments or examples in a suitable manner. In addition, those skilled in the art can combine and integrate different embodiment(s) or example(s) described in this specification.

An electronic cigarette vaporizer provided in the embodiment as shown in FIG. 1 may include a vaporizer base 2 and a liquid reservoir 1 connected with a vaporizer. An atomizing cavity is formed by an inner cavity obtained by a connection between the liquid reservoir 1 and the vaporizer base 2. The liquid reservoir 1 is provided with an air inlet passage communicating with the atomizing cavity. The liquid reservoir 1 may also be provided with an adjusting knob 3 arranged at the entrance of the air inlet passage for adjusting air inflow. The adjusting knob 3 is provided with an air inlet 34. By rotating the adjusting knob 3, the positions of the air inlet 34 and the entrance of the air inlet passage may be relatively changed so as to realize the adjustment of air inflow of the electronic cigarette vaporizer. Preferably, the shape of the air inlet 34 is identical to that of the entrance of the air inlet passage. The air inlet 34 has a semi-arc shape. Specifically, since the adjusting knob 3 is arranged at the entrance of the air inlet passage, the area where the air inlet 34 on the adjusting knob 3 communicates with the entrance of the air inlet passage can be changed by rotating the adjusting knob 3, thereby realizing the adjustment of air inflow. In this respect, the larger the area where the air inlet 34 communicates with the entrance of the air inlet passage, the greater the amount of air intake; otherwise, the smaller the area, the lesser the air inflow. The amount of air intake is positively related to the amount of smoke produced by the electronic cigarette vaporizer.

Figure 2:
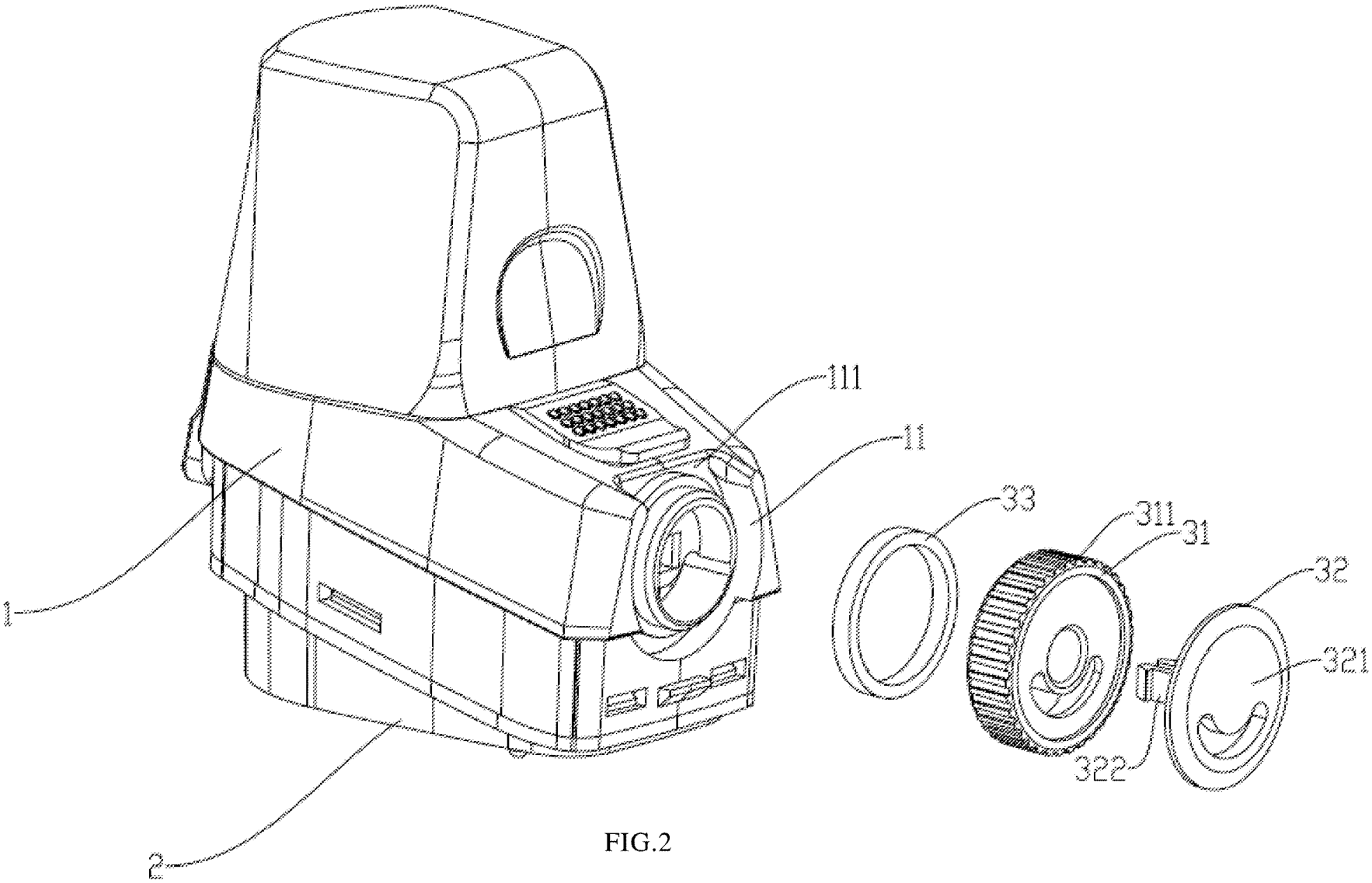
FIG. 2 is a schematically partially exploded diagram of the electronic cigarette vaporizer shown in FIG. 1.
Figure 3:
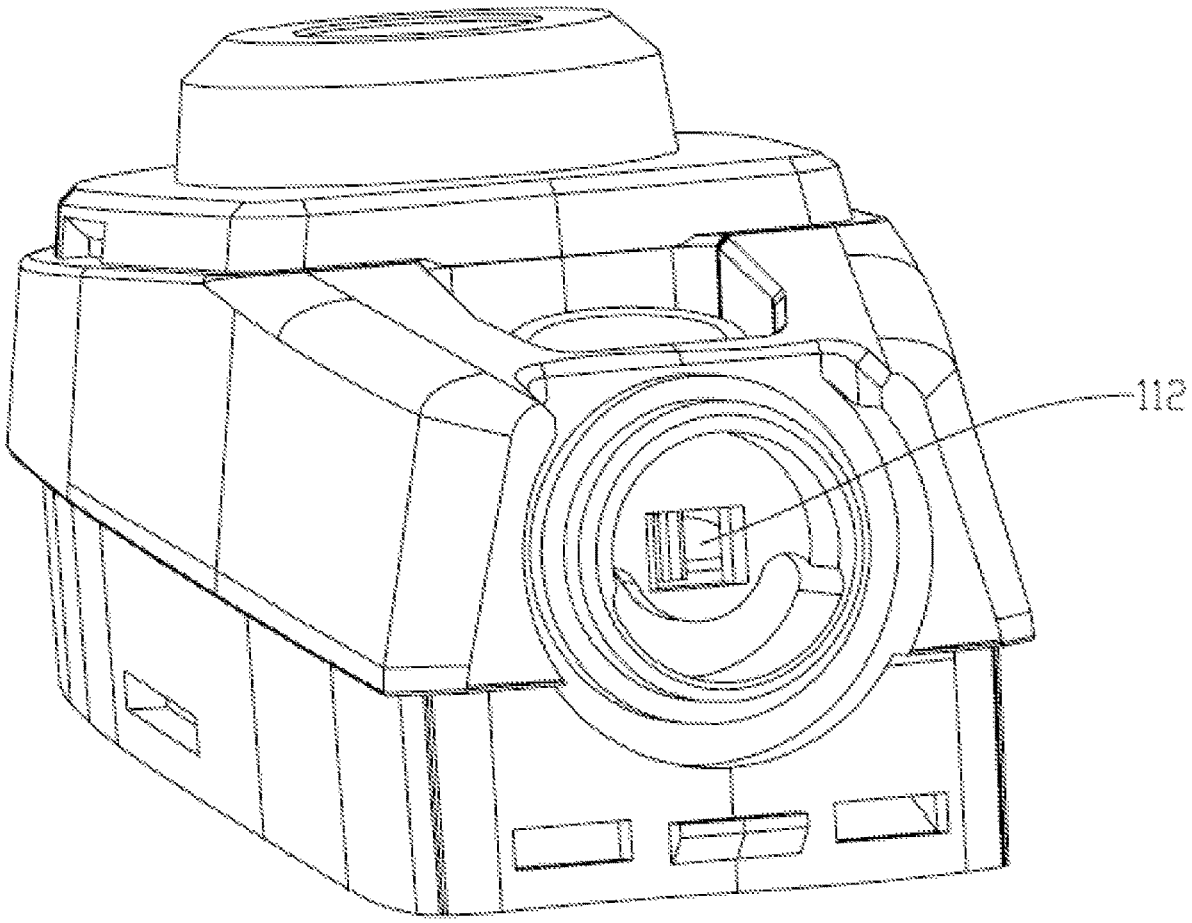
FIG. 3 is a schematically structural diagram of a liquid reservoir in the electronic cigarette vaporizer shown in FIG. 1.
Figure 4:
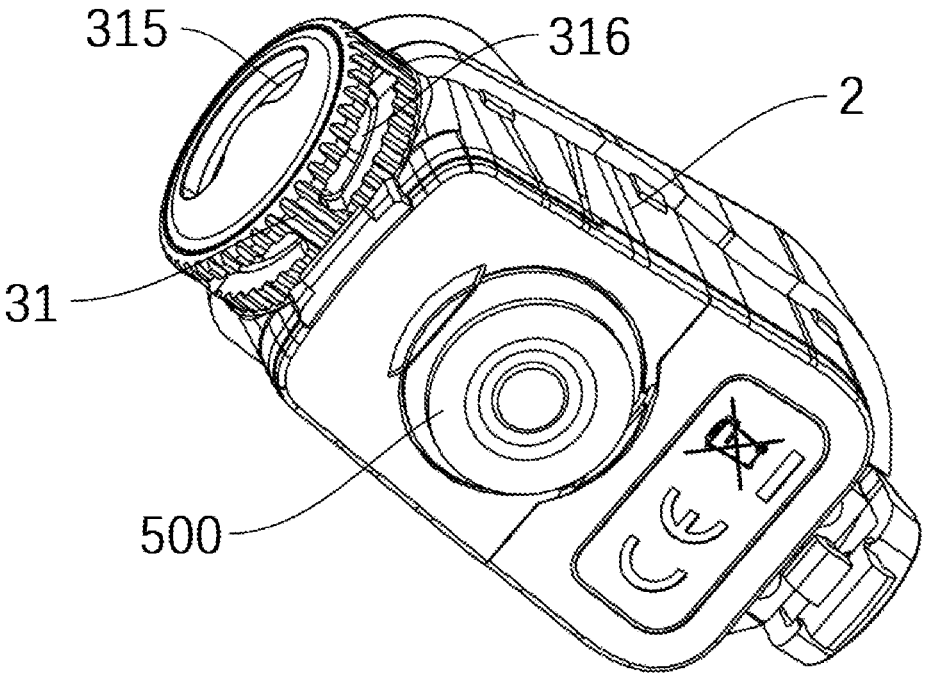
FIG. 4 is a schematically assembled diagram of an electronic cigarette vaporizer according to another embodiment of the present disclosure.

As shown in FIGS. 2-3, the adjusting knob 3 includes an air adjusting ring 31 and a fixed mount 32. The fixed mount 32 includes a clamping portion 322 and a limit portion 321 fixedly connected to the outer end of the clamping portion 322. The air adjusting ring 31 is sleeve-connected to the clamping portion 322. The inner end of the clamping portion 322 is fixedly connected to the liquid reservoir 1. A connecting hole 112 is arranged at the bottom of the mounting groove 11, and the inner end of the clamping portion 322 is clamped in the connecting hole 112. The fixed mount 32 functions as a support for the air adjusting ring 31. When the air adjusting ring 31 rotates, the fixed mount 32 does not rotate. Preferably, the adjusting knob 3 further includes a sealing gasket 33 which gets through the outer periphery of the clamping portion 322 and is located inside the air adjusting ring 31. The sealing gasket 33 provided can improve the sealing performance of the electronic cigarette vaporizer and prevent external liquid from entering the inside of the electronic cigarette vaporizer.

Furthermore, as shown in FIG. 2, the liquid reservoir 1 is provided with a mounting groove 11 for installing the adjusting knob 3. The mounting groove 11 is provided with a notch portion 111, and the adjusting knob 3 is at least partially protruded outside the notch portion 111. The notch portion 111 provided can facilitate a user's thumb to rotate the air adjusting ring 31. Preferably, the air adjusting ring 31 is provided with a plurality of antislip ribs 311 along its outer circumferential surface. The antislip ribs 311 provided have an anti-slip effect, which is more conducive to adjustment.

An electronic cigarette vaporizer is provided in another embodiment which is difference from the above-mentioned embodiment in that an adjusting air inlet is further included, improving the adjustment range without increase of the volume of the vaporizer itself and meeting the needs of high-power vaporizer.

In the electronic cigarette vaporizer of this embodiment as shown in FIGS. 4-7, the air adjusting ring 31 includes a bottom plate 312 and a peripheral wall 313 that are connected. The bottom plate 312 is provided with a mounting hole 314 and at least one first air inlet 315, and the peripheral wall 313 is provided with at least one second air inlet 316. The fixed mount 32 rotates relative to the air adjusting ring 31 through the mounting hole 314 to cooperate to adjust the first air inlet 315. The liquid reservoir 1 is provided with an annular plate 12 with a notch 121. The air adjusting ring is sleeved outside the annular plate 12. The inner of the annular plate 12 is provided with a third air inlet 122 communicating with the first air inlet 315, and a fourth air inlet 123 communicating with the notch 121 and the second air inlet 316. The air adjusting ring 31 rotates relative to the annular plate 12 to cooperate to adjust the second air inlet 316. The atomization generator 400, arranged in the liquid reservoir 1 and the vaporizer base 2, is provided inside with an airflow passage 410. The airflow passage 410 is communicated with the third air inlet 122 and the fourth air inlet 123 through the air inlet passage. The liquid reservoir 1 is provided inside with an air outlet passage communicating with the airflow passage 410 and extending out of the liquid reservoir 1.

The fixed mount 32 cooperated with the first air inlet 315 for adjustment and the annular plate 12 having the notch 121 cooperated with the second air inlet 316 for adjustment can improve the adjustment range without increase of the volume of the vaporizer itself and meet the needs for high-power vaporizer.

Figure 5:
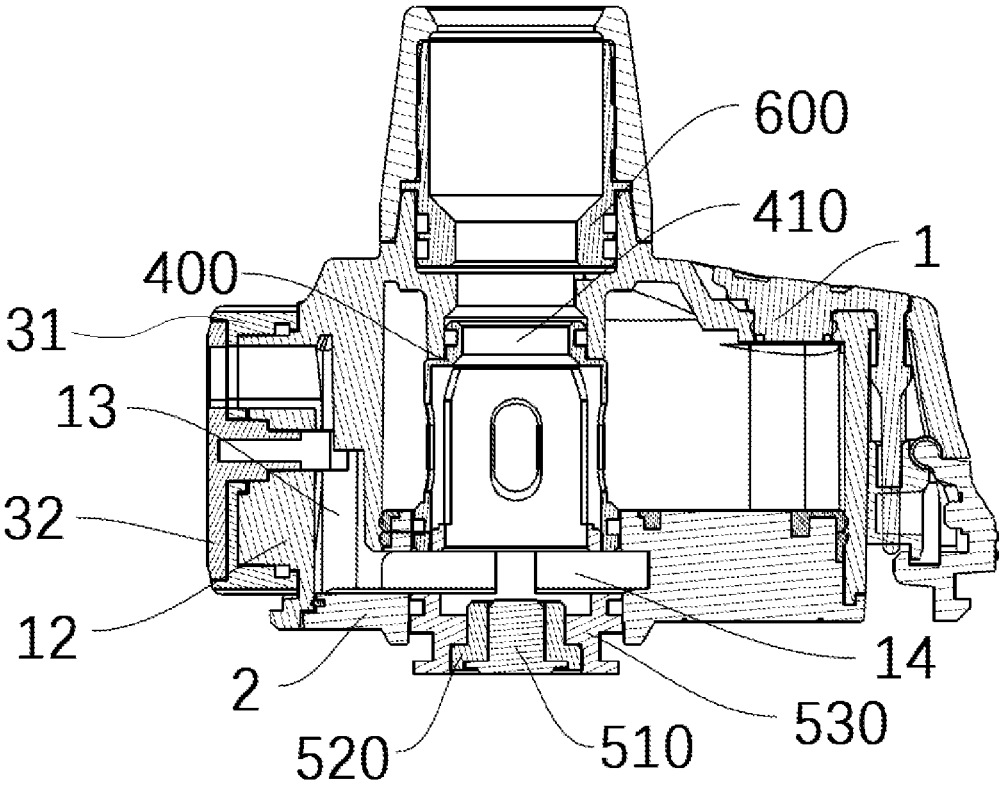
FIG. 5 is a schematically cross-sectional structure diagram of the electronic cigarette vaporizer shown in FIG. 4.
Figure 6:
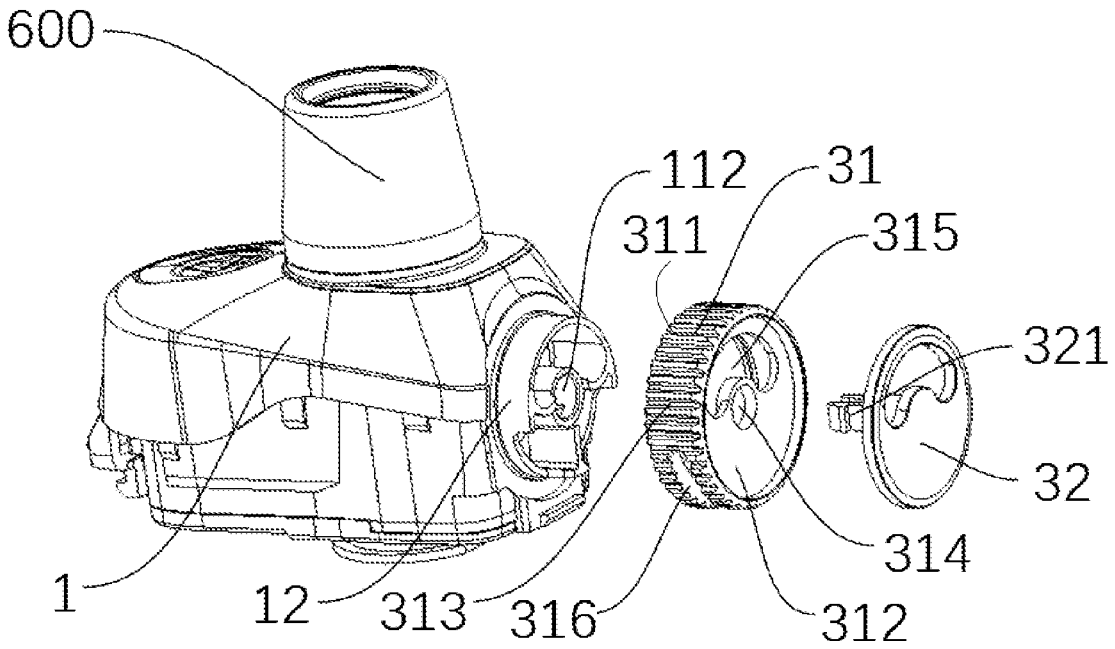
FIG. 6 is a schematically partial exploded diagram of the electronic cigarette vaporizer shown in FIG. 4.
Figure 7:
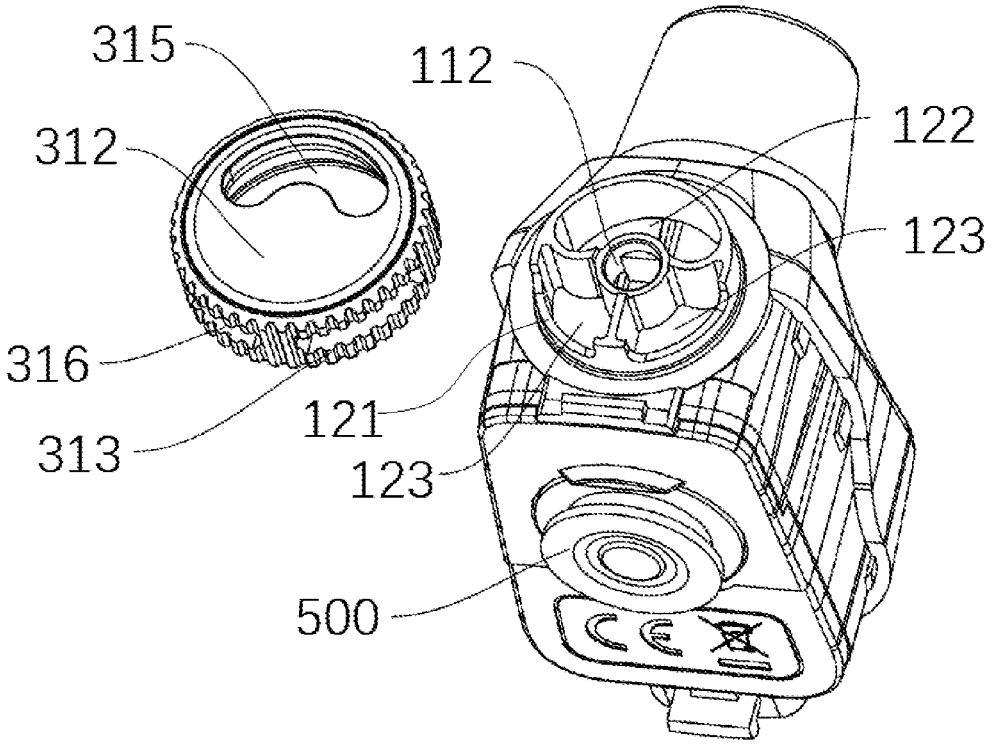
FIG. 7 is a schematically partial exploded diagram of an electronic cigarette vaporizer in another direction according to the present disclosure.

As shown in FIGS. 5-7, the air inlet passage communicating the third air inlet 122 and the fourth air inlet 123 is arranged in the electronic cigarette vaporizer and communicates with the airflow passage 410 arranged in the atomization generator 400. In the electronic cigarette vaporizer, one air inlet passage connected with the third air inlet 122 and the fourth air inlet 123 can be beneficial to reduce the overall volume. In particular, the third air inlet 122 and the fourth air inlet 123 communicate to form a larger hole. In still another embodiment, the electronic cigarette vaporizer is provided with two air inlet passages, one of which is connected to the third air inlet 122 and the other one to the fourth air inlet 123. The electronic cigarette vaporizer is provided inside with the atomization generator 400 provided inside with the airflow passage 410. The airflow passage 410 communicates with the third air inlet 122 through one air inlet passage and with the fourth air inlet 123 through the other air inlet passage, which is beneficial to provide the air inlet passage independently according to the sizes of the third air inlet 122 and the fourth air inlet 123, improving the accuracy of adjusting air intake. It is understandable that the third air inlet 122 and the fourth air inlet 123 are independent and not connected.

The mounting hole 314 can be provided at any position of the bottom plate 312. Preferably, the mounting hole 314 is arranged at the center of the bottom plate 312; further, the first air inlet 315 and the second air inlet 316 are evenly arranged to balance the air intake, so that the efficiency and effectiveness of the first air inlet 315 and the second air inlet 316 are improved. If the area of the first air inlet 315 is to be enlarged, the mounting hole 314 may also be eccentrically arranged.

The shape of the fixed mount 32 can be set as required, such as a circular plate having a through hole or a slot, or a fan-shaped plate, as long as it can adjust the first air inlet 315 by rotation. Preferably, the fixed mount 32 is provided with at least one through hole or slot adapted to the first air inlet 315. In particular, the through hole or slot is larger than the first air inlet 315. The fixed mount 32 can generally cover the first air inlet 315. The first air inlet 315 is generally fan-shaped or arc-shaped for adjustment by rotation conveniently, or it can also be set into other shapes as required.

As shown in FIGS. 5-6, the second air inlet 316 is located on a side away from the first air inlet 315. In particular, the bottom plate 312 is circular, the peripheral wall 313 is annular, the mounting hole 314 is arranged at the center of the bottom plate 312, the first air inlet 315 is arranged in one of the semicircles of the circular bottom plate 312, and the second air inlet 316 is opened at the side away from the first air inlet 315 in another semicircle. The third air inlet 122 and the fourth air inlet 123 may be easily arranged for fully and effectively utilization of space, which can enlarge the maximum air intake of the first air inlet 315 and the second air inlet 316 as much as possible.

Preferably, the air adjusting ring 31 and the liquid reservoir 1 are rotatably connected. A connecting hole 112 is provided on the liquid reservoir 1 and in the annular plate 12. An annular groove or an annular locking block is arranged in the connecting hole 112. The fixed mount 32 is provided with a clamping portion 322 which passes through the connecting hole 112 and clamps the annular groove or the annular locking block in the connecting hole 112. The clamping portion 322 may be a hook. The air adjusting ring 31 is rotatably connected to the liquid reservoir 1 via the fixed mount 32. The air adjusting ring 31 can be rotated relative to the liquid reservoir 1 by the annular groove or the annular locking block, that is, the first air inlet 315 or the second air inlet 316 can be used alone, or the first air inlet 315 and the second air inlet 316 can be used at the same time, greatly increasing the flexibility of adjustment. In yet still another embodiment, the air adjusting ring 31 is fixedly connected to the liquid reservoir 1. The air adjusting ring 31 can be screwed or fixedly clamped with the liquid reservoir 1. As shown in FIGS. 6-7, the connecting hole 112 is provided on the liquid reservoir 1 and in the annular plate 12. A fixed locking slot or a fixed locking block is arranged in the connecting hole 112. The air adjusting ring 31 is provided with the clamping portion 322 which passes through the connecting hole 112 and clamps the fixed locking slot or the fixed locking block in the connecting hole 112. The air adjusting ring 31 is fixedly connected to the liquid reservoir 1 through the clamping portion 322 and the fixed locking slot or the fixed locking block. The air adjusting ring 31 is fixed connected to the liquid reservoir 1. The first air inlet 315 and the second air inlet 316 are adjusted by the rotation of the air adjusting ring 31, which is simple and convenient in operation. In this respect, it is preferable that the connecting hole 112 is arranged at the center of the bottom plate 312.

As shown in FIG. 5, the annular plate 12 is arranged on the side of the atomization generator 400, and the air inlet passage in an "L" shape includes a vertical channel 13 and a transverse channel 14. An end of the vertical channel 13 away from the transverse channel 14 is communicated with the third air inlet 122 and the fourth air inlet 123. The atomization generator 400 and a power supply base 500 are respectively arranged on both sides of the transverse channel 14. Air intake from the side is conducive to reducing the overall volume and increasing the range of air intake adjustment. The "L" shape of the air inlet passage helps avoid liquid leakage. It is understandable that a heating element and a porous body that is heated by the heating element to generate smoke are arranged in the atomization generator 400. The pins of the heating element are connected to a heating base through the transverse channel 14. Generally, each heating element is provided with two pins, one of which is connected to the positive electrode 510 of the power supply base 500 and the other one to the negative electrode 530 of the power supply base 500. The positive electrode 510 and the negative electrode 530 of the power supply base 500 are generally insulated and isolated by insulating glue 520 or an insulating ring.

As shown in FIG. 5, the transverse channel 14 is arranged in the vaporizer base 2, and the vertical channel 13 is arranged in the liquid reservoir 1. A small groove and a large groove that are communicated are arranged in the liquid reservoir 1. The large groove is communicated with the vertical channel 13. The vaporizer base 2 includes a small protrusion and a large protrusion separated by the transverse channel 14. The small protrusion is extended into the small groove and is connected in a sealed manner, and the large protrusion is extended into the large groove and is connected in a sealed manner. The atomization generator 400, one end of which is coupled to the liquid reservoir 1 and the other end to the vaporizer base 2, is arranged in the small groove. The atomization generator 400 is easily to be mounted. The vaporizer base 2 is generally sealed with the liquid reservoir 1 by a sealing ring in an interference fit.

As shown in FIG. 5, the airflow passage 410 of the atomization generator 400 extends from one end of the liquid reservoir 1 to form an outlet at which a cigarette holder 600 is arranged. An isolating gap is arranged between the cigarette holder 600 and the atomization generator 400 for alleviate or isolate heat transfer, preventing the cigarette holder 600 from getting too hot.

In conclusion, by the air adjusting ring cooperated with the first air inlet for adjustment and the annular plate having the notch cooperated with the second air inlet for adjustment in the electronic cigarette vaporizer in the present disclosure, the adjustment range can be improved without increase of the volume of the vaporizer itself. Moreover, the flexibility of adjustment can be greatly increased by using alone the first air inlet or the second air inlet or using both the first air inlet and the second air inlet at the same time, as required.

Figure 8:
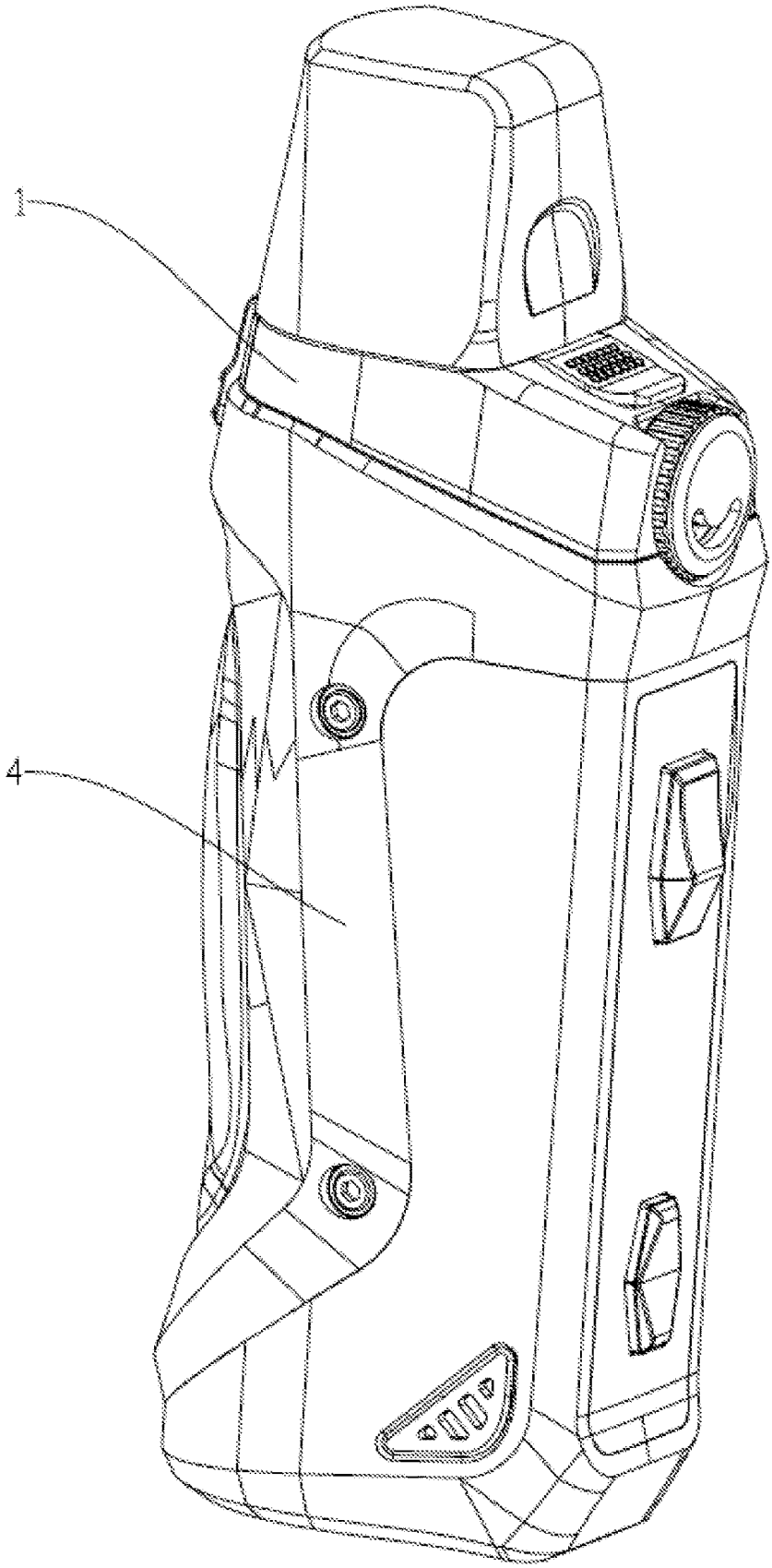
FIG. 8 is a schematically assembled diagram of an electronic cigarette vaporizer according to still another embodiment of the present disclosure.

An electronic cigarette is also provided in an embodiment as shown in FIG. 8. The electronic cigarette includes a power supply component 4 and the above-mentioned electronic cigarette vaporizer that is connected above the power supply component 4. The power supply component 4 is used to provide electrical energy for the electronic cigarette vaporizer. The power supply component 4 may be a commonly used power supply component 4 for electronic cigarettes in the market, the structure of which will not be repeated herein.

Further, the electronic cigarette vaporizer is detachably connected to the upper side of the power supply component 4. With detachable connection mode, the power supply component 4 or the electronic cigarette vaporizer can be replaced easily.

With the electronic cigarette composed of the electronic cigarette vaporizer and the power supply component 4 of the present disclosure held by a user, the adjusting knob 3 is just at the thumb of the user's hand and the adjusting knob 3 can be rotated through the thumb, thereby achieving rapid and convenient adjustment to air inflow and improving user experience.

The technical contents of the present disclosure are illustrated by the above-mentioned embodiments for easier understanding of readers; however, it does not mean that the implementation of the disclosure is limited thereto. Any technical extension or re-creation made according to this disclosure shall be subject to and be protected by this disclosure. The scope of protection of this application is subject to the claims.

What is claimed is:

1. An electronic cigarette vaporizer, comprising a vaporizer base, and a liquid reservoir connected with the vaporizer base;

wherein an atomizing cavity is formed by an internal cavity obtained by the connection of the liquid reservoir and the vaporizer base;

an air inlet passage communicated with the atomizing cavity is arranged at the liquid reservoir;

an adjusting knob at the entrance of the air inlet passage for adjusting air inflow is also arranged at the liquid reservoir;

an air inlet is arranged at the adjusting knob; and by rotating the adjusting knob, the air inflow can be adjusted by relative position changes of the air inlet and the entrance of the air inlet passage;

wherein the liquid reservoir is provided with a mounting groove for installing the adjusting knob; the mounting groove is provided with a notch portion; and the adjusting knob is at least partially protruded outside the notch portion;

wherein the adjusting knob comprises an air adjusting ring and a fixed mount; the fixed mount comprises a clamping portion and a limit portion fixedly connected to the outer end of the clamping portion; the air adjusting ring is sleeve-connected to the clamping portion; and the inner end of the clamping portion is fixedly connected with the liquid reservoir;

wherein the air adjusting ring comprises a bottom plate and a peripheral wall that are connected, the bottom plate is provided with a mounting hole and at least one first air inlet, and the peripheral wall is provided with at least one second air inlet; the fixed mount is relatively rotated to the air adjusting ring through the mounting hole by rotating the air adjusting ring to adjust the first air inlet; the liquid reservoir is provided with an annular plate having a notch, the air adjusting ring is arranged outside the annular plate, a third air inlet and a fourth air inlet are arranged in the annular plate, the third air inlet is communicated with the first air inlet, the fourth air inlet is communicated with the notch and the second air inlet, and the annular plate is relatively rotated to the air adjusting ring by rotating the air adjusting ring to adjust the second air inlet; and an atomization generator is arranged between the liquid reservoir and the vaporizer base, an airflow passage is arranged in the atomization generator and is connected to the third air inlet and the fourth air inlet through the air inlet passage, and an air outlet passage communicated with the airflow passage and extended out of the liquid reservoir is arranged in the liquid reservoir.

2. The electronic cigarette vaporizer according to claim 1, wherein a connecting hole is located in the mounting groove; and the inner end of the clamping portion is clamped in the connecting hole.

3. The electronic cigarette vaporizer according to claim 1, wherein the adjusting knob further comprises a sealing gasket which is arranged inside the air adjusting ring.

4. The electronic cigarette vaporizer according to claim 1, wherein the shape of the air inlet is identical to the shape of the entrance of the air inlet passage.

5. The electronic cigarette vaporizer according to claim 4, wherein the air inlet is arc-shaped.

6. The electronic cigarette vaporizer according to claim 1, wherein the air adjusting ring is provided with a plurality of antislip ribs along its outer circumferential surface.

7. The electronic cigarette vaporizer according to claim 1, wherein the air inlet passage in the liquid reservoir is connected to the third air inlet and the fourth air inlet, or the air inlet passage and another air inlet passage are arranged in the liquid reservoir, one of which is connected to the third air inlet and the other one to the fourth air inlet.

8. The electronic cigarette vaporizer of claim 1, wherein the second air inlet is arranged spaced apart from the first air inlet.

9. The electronic cigarette vaporizer according to claim 1, wherein the annular plate is arranged on the side of the liquid reservoir, the air inlet passage in an "L" shape comprises a vertical channel and a transverse channel, and one end of the vertical channel away from the transverse channel is communicated with the third air inlet and the fourth air inlet.

10. The electronic cigarette vaporizer according to claim 1, wherein a cigarette holder is arranged at the outlet of the air outlet passage, and an isolating gap is arranged between the cigarette holder and the atomization generator.

11. An electronic cigarette, comprising the electronic cigarette vaporizer according to claim 1 and a power supply component; the electronic cigarette vaporizer is connected to the upper side of the power supply component.

12. The electronic cigarette according to claim 11, wherein the electronic cigarette vaporizer is detachably connected to the upper part of the power supply component.

* * * * *